United States Patent [19]

Nguyen

[11] Patent Number: 4,762,030

[45] Date of Patent: Aug. 9, 1988

[54] FASTENER COLLAR REMOVAL TOOL

[75] Inventor: Peter D. Nguyen, San Diego, Calif.

[73] Assignee: General Dynamics Corporation/Convair Div., San Diego, Calif.

[21] Appl. No.: 111,009

[22] Filed: Oct. 21, 1987

[51] Int. Cl.[4] ..... B25B 21/00

[52] U.S. Cl. ..... 81/55; 81/13; 81/472

[58] Field of Search ..... 81/112, 113, 57.32, 81/55, 9.24, 53.2, 13, 472, 473, 474, 475, 476

[56] References Cited

U.S. PATENT DOCUMENTS

| | | | |
|---|---|---|---|
| 1,232,735 | 7/1917 | Torvik | 81/112 |
| 3,693,381 | 9/1972 | McGee | 81/474 |
| 3,789,705 | 2/1974 | Naslund | 81/13 |

*Primary Examiner*—Frederick R. Schmidt
*Assistant Examiner*—Lawrence Cruz
*Attorney, Agent, or Firm*—John R. Duncan

[57] ABSTRACT

A tool for removal of round internally threaded collars from high efficiency aerospace fasteners. The tool includes a central cylindrical pin having a head at one end held against rotation, a non-round extension at the second end and a transverse bore intermediate the ends, containing a ball which is spring biased to project slightly beyond the pin wall. A mandrel assembly surrounds the pin and is rotatable relative thereto. A gripping collet is positioned between the mandrel and pin with collet fingers at one end extending beyond the mandrel and a threaded second end threaded into said mandrel. An axial slot in said collet is adapted to receive said ball when aligned therewith to form a releasable latch mechanism. In operation, the open collet fingers are placed over a threaded collar with said extension in engagement with a corresponding recess in the end of the bolt within the collar. The socket and mandrel are rotated in the collar unthreading direction. The latch mechanism latches the pin and collet together, preventing rotation of the collet. This causes the mandrel to thread into the collet and move downwardly forcing the fingers to grip onto the collar and bringing frictional contact between the mandrel and collet. This frictional contact tries to force the collet to rotate with the mandrel, to thus cause the latch to release and the collet to rotate with the mandrel. Continued rotation of the mandrel causes the collet fingers to further tighten on the collar until the collar unthreads from the bolt.

7 Claims, 2 Drawing Sheets

FASTENER COLLAR REMOVAL TOOL

BACKGROUND OF THE INVENTION

This invention relates in general to tools for disassembling threaded fasteners and, more specifically, a tool for removing round collars from threaded bolts.

A fastening system for aerospace structures, as detailed in U.S. Pat. Nos. 2,940,495 and 3,138,987 has achieved widespread use in the aerospace industry due to its simplicity, consistently controlled preload and minimum size and weight. The fastener basically consists of two parts, a threaded bolt and threaded nut. The nut, which is the key component, consists of a internally threaded collar which threads onto the bolt and has a bearing surface which engages the structure being fastened and a wrenching device which is unitary with the collar and typically has a hexagonal cross-section for engagement by a conventional wrench. The bolt end has a configured recess, typically hexagonal, so that an Allen wrench may be inserted to hold the bolt stationary while the nut is rotated. A groove is provided between the wrenching device and the collar so that as the device is tightened the wrenching device breaks off at a pre-set torque. The break-off torque depends on the depth of the groove, which can be selected to meet different torque requirements.

The collar is a surface of revolution, so that once installed it cannot be rotated by conventional wrenches, so that the pre-selected torque cannot be later inadvertently changed. This "tamper proof" feature eliminates torque inspection after installation.

Such fasteners are widely available from the Hi-Shear Corporation under the "Hi-Lok" trademark and from several Hi-Shear licensees.

These fasteners are very effective and are intended to be permanently installed. Sometimes, however, the fasteners need to be removed due to assembly errors, need to repair the structure, etc. Where access is easy, a worker generally inserts an Allen wrench into the bolt end socket and rotates the collar with locking pliers. However, this technique damages the collar, and may damage the structure surface near the fasteners, especially if the pliers slip during unthreading. Also, tools must be held and operated simultaneously with both hands, requiring some skill and increasing the likelihood of errors and tool slips. Most importantly, access to a relatively large volume of space around the collar is required for these removal tools. Complex aerospace structure often have such fasteners in locations such that the collar is in a "well" or "tunnel" like areas, making access difficult. Special tools, such as the HLH128 Removal Tool from the Hi-Shear Corporation basically uses an offset cam-type closed end wrench to grip the collar while an Allen wrench engages the bolt socket. While this reduces the space needed for access, it still requires two-hand, skilled operation and could result in damage to adjacent surfaces if errors are made.

Other tools remove the collar by splitting it with a high pressure wedge device such as the collar splitters available from American Pneumatics Tool Co. and the Huck Co. While effective, these tools tend to be large, heavy and requires considerable access space and require hydraulic or high pressure air supplies. Other manually operated collar removal tools, such as those available from Continental Air Tools, Inc. operate only in interference fit condition and require considerable effort.

Thus, there is a continuing need for improved devices to operate in both interference and loose fit conditions which are lightweight, require little skill to use, require little access space around the fastener, reduce the risk of damage to adjacent structures, and save time.

SUMMARY OF THE INVENTION

The above noted problems, and others, are overcome by the fastener removal tool of this invention, which basically comprises a central generally cylindrical pin having a head at one end adapted to being held against rotation and a key member at the other end, a rotatable drive socket and locking mandrel assembly surrounding said pin and a collet threaded into the mandrel between the mandrel and pin. A latch arrangement automatically locks the collet and pin together as the collet is driven into a clamping engagement between the mandrel and a collar positioned within the collet fingers. When the fingers are in tight engagement with the collar, the latch mechanism releases, allowing the collet to rotate with the mandrel, unthreading the collar.

BRIEF DESCRIPTION OF THE DRAWING

Details of the invention, and of a preferred embodiment thereof, will be further understood upon reference to the drawing, wherein.

DETAILED DESCRIPTION OF THE INVENTION

Figure 1:
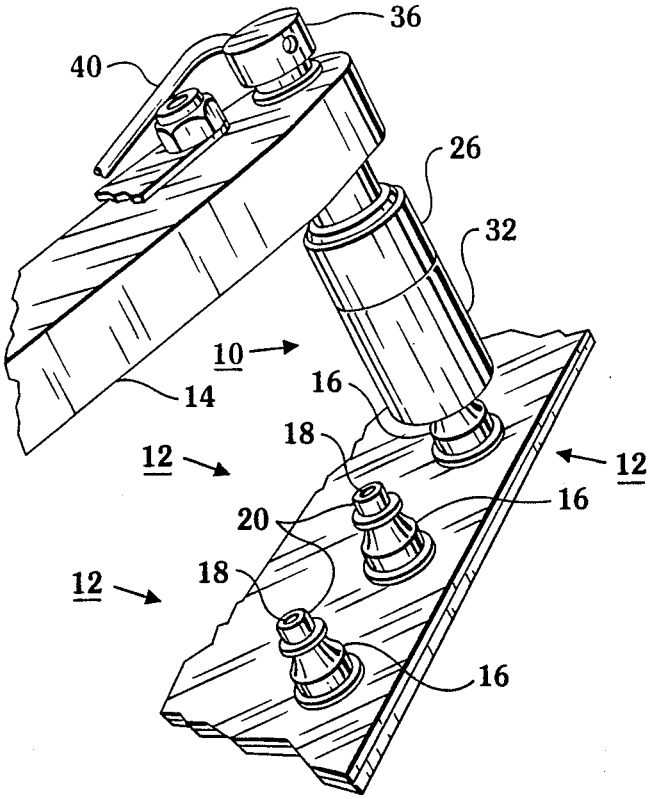
FIG. 1 is a perspective view of my fastener collar removal tool on a drive fixture.

Referring now to FIG. 1, there is seen a perspective view of the collar removal tool 10 in use removing one of several fasteners 12. Tool 10 is mounted for rotation in a conventional air motor drive arm 14 of the sort available, for example, from American Pneumatics Tool Co. As is detailed below, the tool is placed over the collar 12 with a correspondingly-shaped pin (here, hexagonal) engaging recess 18 in bolt 20. The motor is then turned on to rotate the tool counter clockwise, to rotate and unthread collar 16 from bolt 20.

Figure 2:
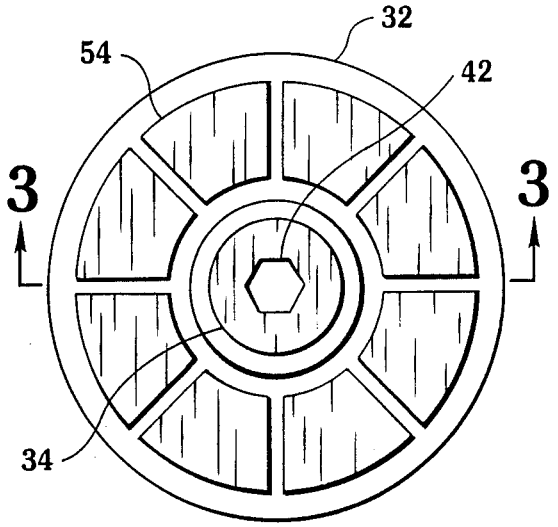
FIG. 2 is an axial section view through the tool.
Figure 3:
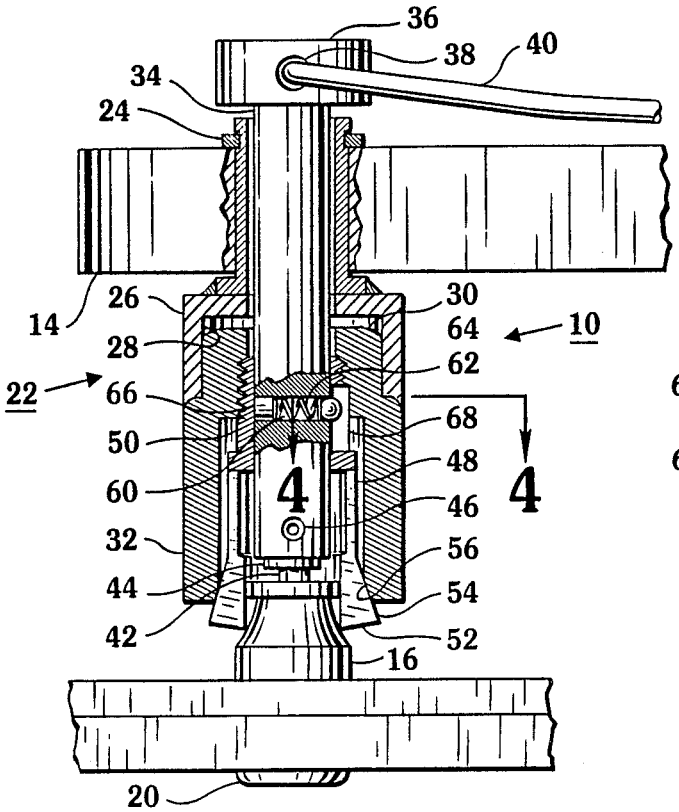
FIG. 3 is a plan view of the tool from the collet end.
Figure 4:
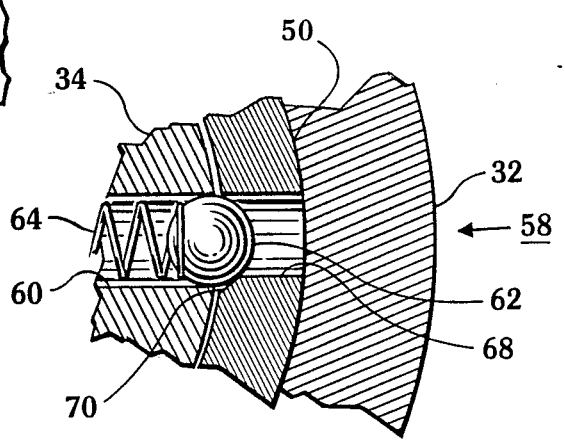
FIG. 4 is a section view of the tool, taken on line 4—4 in FIG. 3.

Details of tool 10 are shown in FIGS. 2–4, which can be considered together.

FIG. 2 in a view looking upwardly at the collet end of tool 10 without a collar 16 in place, FIG. 3 is an axial section view taken substantially on line 3—3 in FIG. 2 and FIG. 4 is a detail section view of the ball-detent latch mean, taken substantially on line 4—4 in FIG. 3.

The upper end of mandrel assembly 22 has a non-circular (typically square or hexagonal) cross-section to fit in a rotatable receiver in drive arm 14. Mandrel assembly 22 is held in place by a conventional spring clip 24 so that mandrel 22 can be rotated by internal drive means (not shown) within arm 14.

While mandrel assembly 22 may be formed as one piece, for greater versatility, it is preferred that a two-piece mandrel assembly be used, as seen in FIG. 3. Upper portion 26 has a downwardly extending female socket 28 which receives an upwardly extending male member 30 on lower mandrel position 32. Socket 28 and cooperating member 30 have complementing non-round cross-sections, typically square or hexagonal, causing both portions to rotate together. Lower portion 32 (together with other components described below) is sized to fit over a single size of collar 16. If a different sized collar is to be removed, lower portion 32 can easily be replaced with another of the appropriate diameter, as is described in greater detail below.

A cylindrical pin 34 is rotatably located within mandrel assembly 22. Pin 34 includes a head 36 having a transverse opening 38 into which the end of a spring rod 40 can enter. Spring 40 is fastened to arm 14 in a manner which biases pin 34 downwardly while preventing rotation of pin 34 relative to arm 14.

At the opposite end, pin 34 includes a non-round extension 42 (here, a hexagonal end corresponding to an Allen wrench,) adapted to fit a complementary socket in bolt 20. While extension 42 may be formed integrally with pin 34, it is preferred that extension 42 be on a short cylinder 44 which fits in a corresponding bore in the end of pin 34 and is held in place by setscrew 46. This permits removal and replacement of extension 42 with others fitting different recesses in the ends of different bolts 20.

A collet 48 is positioned between lower portion 32 of mandrel assembly 22 and pin 34. Collet 48 includes an externally threaded (left-hand threads) first end 50 which threads into internal threads in mandrel 32.

Collet fingers 52 extend downwardly beyond extension 42 and beyond mandrel 32. Fingers 52 have an outwardly flared surface 54 adapted to engage mandrel edge 56 as mandrel 32 is threaded downwardly into collet 48, causing fingers 52 to move together in a gripping manner.

A latch mean 58 (as best seen in FIGS. 3 and 4) is positioned to latch and release pin 34 and collet 48 during tool operation. Here, latch 58 consists of a transverse bore 60 through pin 34 containing a ball 62, a spring 64 and a threaded plug 66. The bore 60 has a slightly reduced diameter at the ball end to prevent ball 62 from being expelled from pin 34.

A vertical slot 68 is adapted to receive the projecting ball when pin 34 and collet 48 are rotationally positioned with ball and slot in alignment.

In use, the tool 10 is installed in a drive arm 14, spring rod 40 is inserted in opening 38, collet 48 is rotated slightly clockwise so that fingers 52 project beyond mandrel 22 and are suitably spaced apart. The fingers 52 are placed over a collar 16 to be removed with extension 42 in the end socket of bolt 20. Spring 40 permits a limited amount of endwise movement of pin 34 so that extension 42 can engage bolt sockets of somewhat varying distances below the top of collar 16.

The drive mechanism of arm 14 is then turned on to rotate mandrel 22 in a counterclockwise direction. Collet 48 rotates with mandrel 22 until ball 62 reaches slot 68, whereupon the ball enters the slot, latching pin 34 to collet 48 and stopping collet rotation.

Continued rotation of mandrel 22 relative to the now-stationary collet causes mandrel 22 to thread downwardly into collet 48, causing fingers 52 to engage mandrel edge 56 and be forced inwardly until they grip collar 16. Ball 62 moves correspondingly along slot 68. As frictional forces between contacted surfaces 56 and 54 increases, ball 62 is forced out of slot 68, by the differential rotational forces unlatching latch 58 and allowing collet 48 to rotate and unthread collar 16 from bolt 20.

The force necessary to "pop" ball 62 out of slot 68 further tightens collet fingers 52, assuring a firm grip on collar 16. In order to avoid excessive ball-release forces it is preferred that the release side of slot 68 be slightly chamfered as shown at 70 in FIG. 4. With a 0.080 inch diameter ball, about a 0.003 inch chamfer gives best results.

While the latch embodiment shown in FIG. 4 is preferred for simplicity and ease of operation, it may not be optimum in all cases. After a collar 16 is removed with the tool, the mandrel assembly 22 may be rotated in the opposite (clockwise where a conventional collar has been removed by counter clockwise rotation) direction. Ball 62 re-enters slot 68 and engages the un-chamferred side of the slot, necessitating further rotation, loosening finger 52 from mandrel 16. In some cases this force will be insufficient and pliers may be required to remove collar 16. Where this is a problem, the latch embodiment shown in FIGS. 5–7 may be preferred for a more positive collar release. In this embodiment, most components are the same as shown in FIGS. 1–3, except that a pivoting blade replaces the ball latch mechanism.

Figure 5:
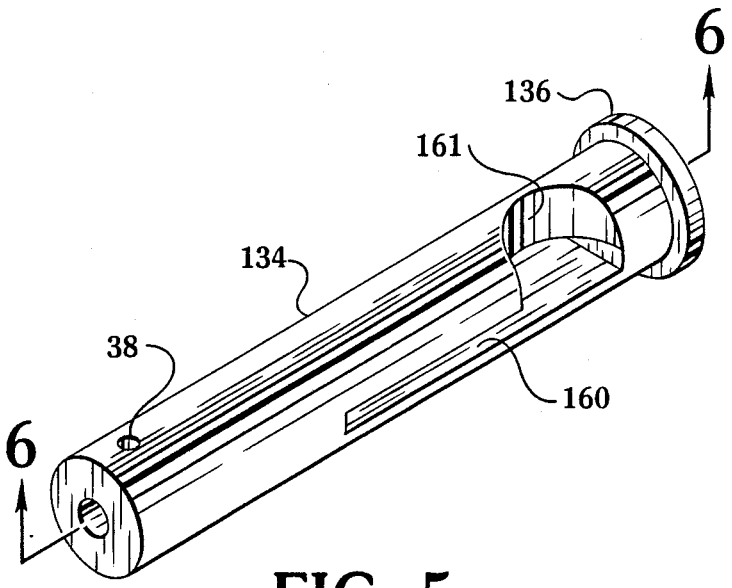
FIG. 5 is a perspective view of an alternative embodiment of a central pin useful in the tool of FIG. 1.
Figure 6:
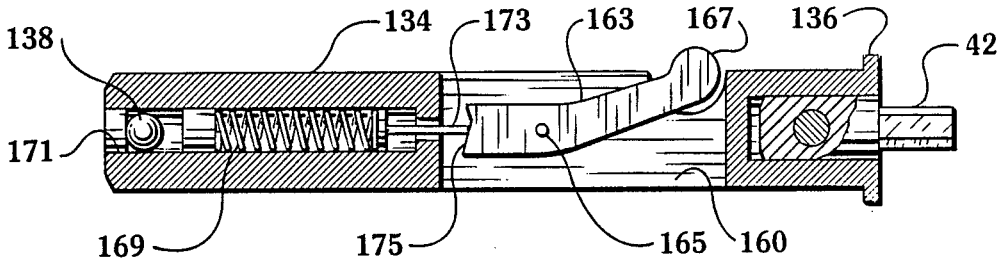
FIG. 6 is an axial section view showing the central pin and associated latch mechanism taken on a line corresponding to line 6—6 in FIG. 5.
Figure 7:
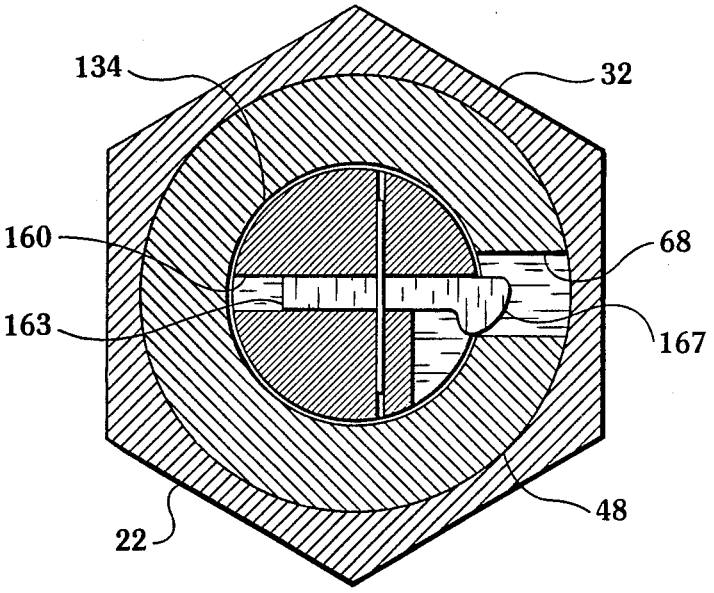
FIG. 7 is a section view of the embodiment of FIG. 5 in the assembly of FIG. 3, taken essentially on line 4—4 in FIG. 3.

Considering FIGS. 5–7 together, there is seen a pin 134 corresponding in general to pin 34 in FIG. 3. In this embodiment, however, rather than having an enlarged head 36 at the upper end, an enlarged head or flange 136 is provided at the lower end. Retaining opening 138 remains in the upper end of the pin, to receive spring 40 as seen in FIG. 1. This alternative head arrangement allows pin 134 to be inserted from the finger 52 end of the assembly. Head 136 further aids in preventing collet 48 from dropping out of the assembly should it become entirely unthreaded from mandrel 22.

Pin 134 has an axial slot 160 having a semi-circular cutout 161 at one end. A blade 163 is pivotably mounted on pin 165 within slot 160 as seen in FIGS. 6 and 7. A first end of blade 163 bears a projection 167 having the general shape of a quarter-sphere.

A spring 169 within an axial bore 171 within pin 134 presses a pin 173 against a sloping end 175 of blade 163 to bias blade 163 towards the position shown in FIG. 6, with projection 167 extending beyond the wall of pin 134. A moderate force is sufficient to press projection 167 back into slot 160 against the force of spring 169.

In operation, as best seen in FIG. 7, as the collet 48 is rotated counter-clockwise as described above, the spherical surface of projection 167 is brought into contact with the edge of slot 68 and is forced to pivot about pin 165 to retract projection 167 as the projection "pops" over the slot edge. The collect fingers engage the collar and unthread it, as described above in conjunction with the description of FIG. 3.

Once the collar is removed, the drive motor direction is reversed. Blade 163 pivots outwardly as projection 167 passes slot 68 so that projection 167 reenters the slot. As clockwise movement of collet 48 continues, the flat side of projection 167 engages the side of slot 68, stopping rotation of collet 48 and unthreading collet 48 from mandrel 22, releasing the grip of fingers 52 (FIG. 3) on collar 16. Generally, a mere "touch" or "blip" on the reverse switch is sufficient to release the collar. If the clockwise rotation is continued slightly longer than necessary, collet 48 may entirely unthread from mandrel 22. Head 136 will prevent collet 48 from dropping out of the assembly. Collet 48 can then be easily manually re-threaded into mandrel 22 prior to the next collar removal operation. As seen in FIG. 7, the exterior surface of mandrel 22 can have a hexagonal, rather than circular, cross-section if desired.

While certain preferred components, arrangements and relationships were detailed in the above description of a preferred embodiment, those may be varied, where suitable, with similar results. For example, the collet fingers may be configured to engage collars of other shapes and different latch mechanisms could be used, if desired.

Other variations, applications and ramifications of this invention will occur to those skilled in the art upon reading this disclosures. Those are intended to be included within the scope of this invention, as defined in the appended claims.

I claim:

1. A fastener collar removal tool which comprises a central cylindrical pin having a head at a first end lockable against rotation and a keyed second end;

a mandrel assembly surrounding said pin for rotation relative thereto;

a collet positioned between said pin and mandrel adapted to be selectively rotated relative to either said pin or said mandrel;

a plurality of gripping fingers on a first end of said collet extending along said pin second end;

the second end of said collet having threads adapted to thread into corresponding threads in said mandrel;

releasable latch means resiliently biased between said pin and collet adapted to initially latch said collet to said pin and release said collet in response to differential rotational forces;

whereby rotation of said mandrel relative to said pin in a selected direction will initially cause said collet to remain stationary and cause said mandrel to thread into said collet moving said mandrel toward said pin second end until said gripping fingers become frictionally engaged between said mandrel and a collar positioned within the fingers whereby said mandrel imposes a rotational force to overcome said latch means and cause said latch means release, thereby allowing said mandrel and collet to rotate together, rotating collar in an unthreading direction.

2. The collar removal tool according to claim 1 wherein said latch means comprises:

a transverse bore through said pin;

A ball movable in said bore;

spring means to bias said ball toward one opening of said bore;

An axial slot in said collet adjacent to said bore;

means permitting said ball to move partially into said slot when ball and slot are aligned;

whereby said ball latches said pin and collet until sufficient differential rotational forces between pin and collet forces said ball from said slot.

3. The collar removal tool according to claim 1 wherein:

said mandrel is formed in two pieces, an upper portion adapted to engage a rotational drive means and having a downwardly directed female socket and a lower portion having an upwardly extending male portion adapted to lockably engage said upper portion;

whereby said lower portion may be removed together with said collet and replaced with a lower portion and collet adapted to fit a different sized collar.

4. The collar removal tool according to claim 1 wherein said second end of said pin has a hexagonal cross-section adapted to fit in a corresponding recess in the end of a bolt on which a collar is mounted.

5. The collar removal tool according to claim 4 wherein said hexagonal second end is removably secured to said pin, whereby said second end can be removed and replaced with an end having a different size.

6. The collar removal tool according to claim 1 wherein said head includes a transverse bore adapted to receive the end of a spring means which prevents rotation of said pin and biases said pin downwardly into said mandrel.

7. The collar removal tool according to claim 1 wherein said latch means comprises:

a blade pivotably mounted in an axial slot in said pin;

a projection at a first end of said blade;

said projection having a rounded first side and a flat second side;

spring means bearing on the second end of said blade to bias said blade to a position with said projection extending beyond said pin slot;

an axial slot in said collet adjacent to said pin adapted to receive the extended projection when rotationally aligned therewith;

whereby upon rotation of said mandrel in one direction an edge of said collet slot will engage the rounded side of said projection to force retraction of said blade so that said collet can rotate relative to said pin and upon rotation of said mandrel in the opposite direction said projection will enter said collet slot and said flat side of said projection will engage a collet slot side to prevent relative rotation between pin and collet.

* * * * *